US005843529A

United States Patent [19]

Peiffer

[11] Patent Number: 5,843,529

[45] Date of Patent: Dec. 1, 1998

[54] PRE-METERING ROD

[75] Inventor: Robert E. Peiffer, Beloit, Wis.

[73] Assignee: Beloit Technologies, Inc., Wilmington, Del.

[21] Appl. No.: 799,126

[22] Filed: Feb. 13, 1997

[51] Int. Cl.[6] ..... B05D 1/00

[52] U.S. Cl. ..... 427/348; 427/359; 427/428; 118/63; 118/249; 118/258; 118/123; 118/413; 118/414; 118/419

[58] Field of Search ..... 118/63, 244, 249, 118/256, 258, 111, 118, 123, 410, 413, 414, 419, 31, 501; 427/348, 359, 428

[56] References Cited

U.S. PATENT DOCUMENTS

| | | | |
|---|---|---|---|
| 3,235,401 | 2/1966 | Fowells et al. | 118/63 |
| 3,279,424 | 10/1966 | Brown, Jr. et al. | 118/63 |
| 3,424,126 | 1/1969 | Mahoney | 118/63 |
| 3,550,553 | 12/1970 | Mahoney et al. | 118/63 |
| 4,005,676 | 2/1977 | Phillips | 118/63 |
| 4,106,429 | 8/1978 | Phillips | 118/63 |
| 4,359,964 | 11/1982 | Johnson | 118/63 |
| 5,171,612 | 12/1992 | Sollinger | 427/428 |
| 5,476,683 | 12/1995 | Elvidge et al. | 427/428 |

OTHER PUBLICATIONS

George Booth, "Coating Equipment and Processes" (1970) pp. 83–91.

Beloit Air Knife Coaters, by Beloit Corporation, Beloit, Wisconsin, 2 pgs., B226D (undated).

*Primary Examiner*—Laura Edwards

*Attorney, Agent, or Firm*—Lathrop & Clark

[57] ABSTRACT

A pre-metering rod is located between a coating applicator and an air knife, and replaces the smoothing roll in some existing air knife applications. The pre-metering rod consists of a small diameter rod of about one and one-half inches in diameter that rotates at 10–500 rpm against the direction of the coating layer on the web. The web is wrapped around a portion of the circumference amounting to about twenty-five degrees of the rod's surface as it travels over the rod. The rod is supported in a rod holder supported on a support beam. Actuators move the support beam away from the web for threading and maintenance, and towards the web to engage the rod with the web. The combination of the rod diameter, the amount of wrap on the rod, and the speed of the rod rotation determine the amount of pre-metering of the coating, which determines the thickness of the coating layer on the web that is presented to the air knife section. As a result, the thickness of the coating layer can be decreased. Decreasing the mass of the coating presented to the air knife decreases the momentum of the coating layer and allows the speed of the web to be increased to over 2,000 feet per minute as it passes through the air knife section.

16 Claims, 1 Drawing Sheet

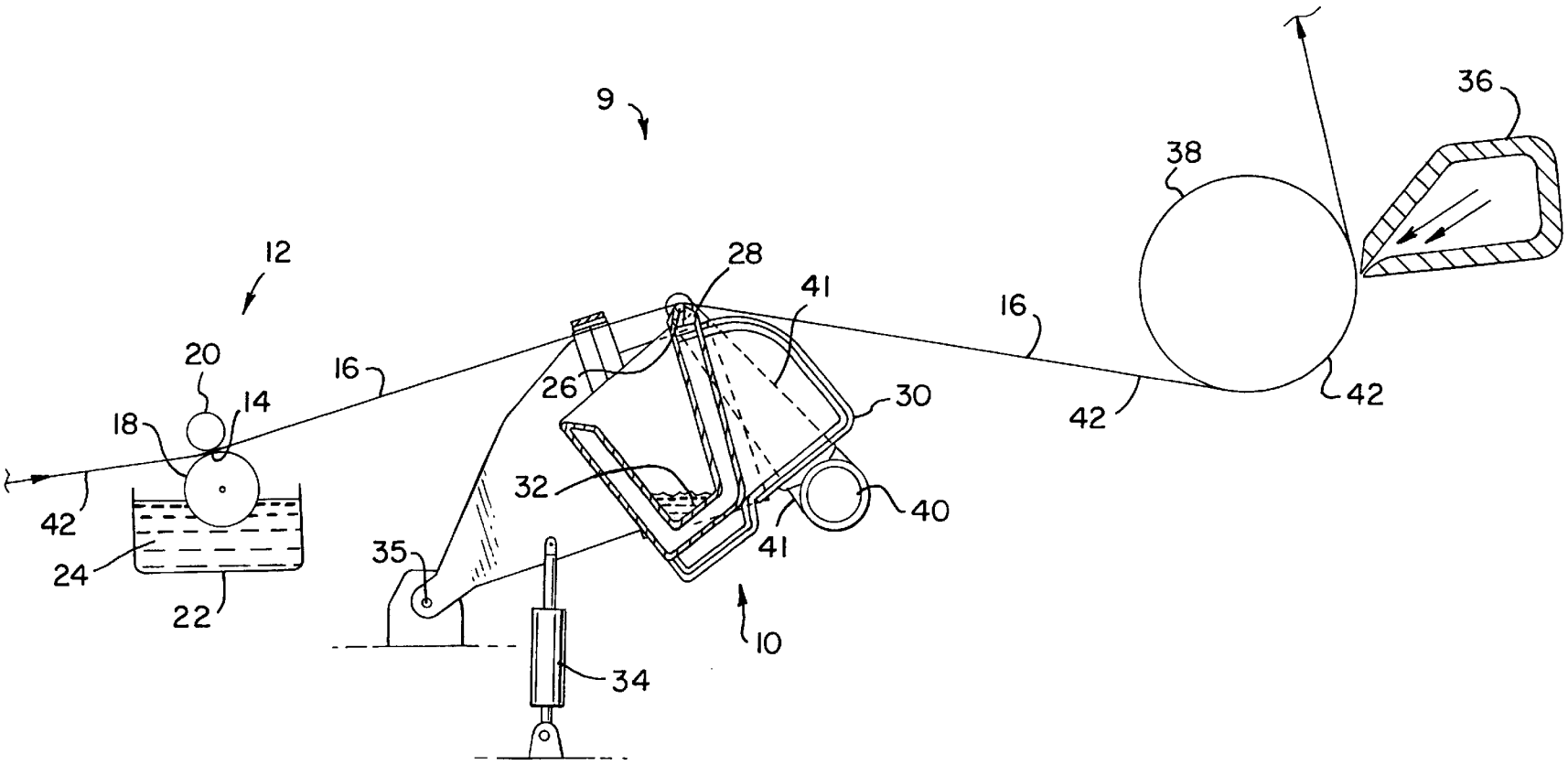
36
42
38
42
16
30
40
41
41
28
10
9
26
32
34
35
16
12
14
20
18
22
24
42

PRE-METERING ROD

FIELD OF THE INVENTION

The present invention relates to apparatus for applying coatings to moving substrates such as paper, applicator rolls, felts, and blankets, in general, and to metering apparatus in particular.

BACKGROUND OF THE INVENTION

Paper of specialized performance characteristics may be created by applying a thin layer of coating material to one or both sides of the paper. Once the coating has been applied to the paper, it is necessary to meter the coating to a desired thickness and uniform level. Uneven coating thickness will produce blemishes and quality variances in the finished paper, and is highly undesirable.

One approach to metering the coating is to employ an air knife coater, which can be used to apply a wide range of grades and coat weights, ranging from 6 lbs. to 18 lbs. per side/3,000 square feet (10–20 gsm). This versatile coater can be used for the production of art paper, bleached and unbleached paperboard, CB coated grades, and protective barrier paper and films. In air knife coating, the process involves first applying a layer of coating to a traveling web, and metering the coating to a thinner layer that is subsequently presented along a backing roll, which stabilizes the web, to an air knife section where a curtain of high velocity air is directed from an air jet against the oncoming web to smooth the coating surface and, in some instances, to doctor off excess coating.

Current methods of pre-metering the coating layer before it is presented to the air knife section utilize a two roll applicator system. The first pre-metering device pre-meters a thin layer of coating on the web and the second pre-metering device levels the coating layer prior to presenting it to the air knife. The second pre-metering device, known as a smoothing roll, consists of a self-supporting roll that rotates against the direction of the web run, with the web wrapping the circumference of the roll at a length approximately equal to 15 degrees. As the web passes over the smoothing roll the coating layer is leveled to a more uniform thickness.

In order for the air coming from the air jet in the air knife section to shear off the coating layer to the desired final thickness on the web, the air momentum of the air jet must be greater than the momentum of the traveling coating layer. Increasing the air momentum requires increasing the air velocity of the air jet, but if the air velocity of the air jet is increased above 0.9 mach number (90 percent of the speed of sound), local shock waves are formed at the air knife lips. These shock waves create a pattern on the coating layer of the paper web, thereby corrupting the quality of the coating layer. Therefore, in order to avoid these highly undesirable quality variances in the coating layer, the air velocity of the air jet cannot exceed speeds greater than 0.9 mach number.

The thickness of the coating layer after it is pre-metered at the smoothing roll in current pre-metering methods, combines with this limitation on the air velocity at the air knife section, to speed limit current air knife coater applications to the neighborhood of 1,500 feet per minute.

With the ever increasing economic demands requiring increased production speeds, it is desirable to increase the speed of the web as it passes through the air knife section. What is needed is a means of presenting a coating to an air knife that reduces the thickness of the coating layer.

SUMMARY OF THE INVENTION

The pre-metering rod of the present invention is located between a coating applicator and an air knife, and replaces the smoothing roll in some existing air knife applications. The pre-metering rod consists of a small diameter rod of ¼ inch to 3 inches in diameter that rotates at 10–500 rpm against the direction of motion of the web. The web is wrapped around a portion of the circumference of between 3 degrees and 40 degrees of the rod's surface as it travels over the rod. The rod is supported in a rod holder supported on a support beam. Actuators move the support beam away from the web for threading and maintenance, and towards the web to engage the rod with the web. The combination of the rod diameter, the amount of wrap on the rod, and the speed of the rod rotation determine the amount of pre-metering of the coating, which determines the thickness of the coating layer on the web that is presented to the air knife section. As a result, the thickness of the coating layer can be decreased. Decreasing the mass of the coating presented to the air knife decreases the momentum of the coating layer and allows the speed of the web to be increased to over 2,000 feet per minute as it passes through the air knife section.

It is a feature of the present invention to provide a pre-metering assembly which permits adjustment in the amount of pre-metering done on the coating layer which permits adjustment of the coating thickness.

It is another feature of the present invention to provide a pre-metering assembly that decreases the momentum of the coating layer as it is presented to the air knife section by decreasing the thickness of the coating layer.

It is a further feature of the present invention to provide a pre-metering assembly that allows increased speed of a web as it travels through an air knife.

It is an additional feature of the present invention to provide a pre-metering assembly that can be moved away from the coating layer so that the pre-metering assembly may be threaded and maintained without removing the assembly from the papermaking machine.

Further objects, features and advantages of the invention will be apparent from the following detailed description when taken in conjunction with the accompanying drawings.

BRIEF DESCRIPTION OF THE DRAWING

The drawing is a schematic elevational cross-sectional view illustrating the pre-metering rod embodying the principles of the present invention.

DESCRIPTION OF THE PREFERRED EMBODIMENT

Referring more particularly to the drawing, a coater system 9 has pre-metering rod assembly 10 positioned downstream from a coating applicator 12 and ahead of an air knife 36 and its backing roll 38. The coating applicator 12 has an applicator roll 18 which defines a nip 14 with a cylindrical backing roll 20. The paper or paperboard web 16 to be coated passes through the nip 14. The applicator roll 18 rotates partially submerged in an open pan 22 of coating 24 and from the pan 22 draws coating 24 to the nip where it is applied to the surface 42 of the web 16.

A sufficient amount of coating is supplied from the pan 22 so that the coating carried on the surface of the applicator roll 18 substantially floods the nip 14 and provides a pressure application of coating to the underside 42 of the web 16. Common coatings consist of a clay slurry which entrains various modifiers which provide an opaque surface receptive to fine printing and graphic images.

After passing through the applicator 12, the web 16 travels to the pre-metering rod assembly 10, where a rod 26 extending in the cross-machine direction rotates against the direction of motion the web 16. The diameter of the rod is between the range of ¼ of an inch to three inches preferably about one and one-half inches. The web 16 wraps about twenty-five degrees of the circumference of the rod 26. The wrap angle can be varied between about three degrees and about forty degrees with the amount of wrap being one parameter which can be varied to control the thickness of the coating on the web 16. As the web 16 passes over the rod 26, the coating applied to the web is metered to a desired uniform thickness for presentation to the air knife 36 positioned over a backing roll 38. The combination of the rod diameter, the amount of wrap on the rod, and the speed of the rod rotation all determine the amount of pre-metering done to the coating layer and the thickness of the coating layer that is presented to the air knife section for final metering.

The rod 26 is supported across the full width of the pre-metering rod assembly 10 in the cross-machine direction by a resilient plastic rod holder 28. The rod holder 28 is supported on a cross machine support beam 30 which has an integral catch pan 32 that carries away the excess coating that is metered off of the web 16. The rod holder 28 is typically constructed of polyurethane or rubber and is similar to rod holders used in conventional coaters where metering rods are used for final metering as opposed to the pre-metering accomplished by the rod 26.

The rod 26 is driven by a variable speed motor 40 through a belt 41 or other means by which the speed of the motor is reduced. The motor can be electric, hydraulic, or air powered. In a preferred embodiment, the rod speed can be varied from 10 to 500 rpm, with perhaps 100 rpm being about optimal. The wrap angle about the rod is about twenty-five degrees and in combination with the rotation of the rod in a direction counter to the motion of the web serves to wipe excess coating from the web.

The air knife 36 utilizes a narrow stream of high velocity air directed against the paper web as the web travels over and is supported on a backing roll 38. The high velocity air when it impacts the surface 42 of the paper at an angle of between about forty and about fifty degrees creates a narrow region of high pressure which smooths and doctors the liquid coating on the web. The air knife 36 is angled toward the direction from which the web is supplied. The air knife 36 has significant advantages over a doctor blade. Because there is no mechanical engagement of the web by a solid object the coating is spread evenly over the fibers making up the web. Air knifes are typically employed when coating liner board. If a doctor blade is used a mottled or galvanized like surface is produced as the blade scrapes the high parts of the web. The air knife is capable of applying a uniform layer of coating over the surface of the liner board.

The energy available to create the pressure applied by the air knife 36 is limited by the velocity of the air stream. The air stream is in turn limited to about 0.9 times the speed of sound. Therefore there is a limit to the level of pressure which an air knife can generate. The liquid coating on the web is moving with the speed of the web and a portion of the coating liquid must be decelerated by the air stream from the air knife if the coating is to be significantly thinned. As the paper web moves faster a point is reached where the momentum of the air stream is insufficient to overcome the momentum of the excess coating liquid. If the excess liquid can not be decelerated it cannot be removed from the web. Thus there is a need to reduce the liquid coating thickness before the air knife if higher web speeds are to be obtained.

The pre-metering rod assembly 10 is mounted on a pivot 35 and moved by actuators 34 which may be hydraulic or pneumatic. The actuators 34 enable the rod 26 to be moved away from the web 16 to facilitate threading and for maintenance. Positioning the rod 26 to control the amount of wrap angle is also affected by the hydraulic cylinder 34.

The coater system 9 employs three components, the coating applicator 12 the permetering assembly 10 and the air knife 36, with backing roll 38. Arranged as shown in the figure the premetering rod 26 which is un-backed presents a thinner layer of coating to the air knife 36 than existing devices are typically able to.

It is understood that the invention is not limited to the particular construction and arrangement of parts herein illustrated and described, but embraces such modified forms thereof as come within the scope of the following claims.

We claim:

1. A coating apparatus comprising:

a coater for applying a liquid coating to a first surface of a moving paper web;

a liquid coating pan for communicating liquid coating to the coater;

a rod having a diameter between about ¼0 and about 3 inches, the rod defining a circumference, the rod extending in a cross machine direction and engaging the web first surface so that between three degrees and forty degrees of the rod circumference is wrapped by the web, and having no opposing backing roll engaging a second surface of the web to form a nip with the rod;

a holder supporting the rod and extending in the cross machine direction;

a liquid coating catch pan for receiving excess liquid coating removed from the web first surface by the rod;

a motor in driving engagement with the rod to cause it to rotate toward the coater for applying a liquid coating;

a backing roll positioned downstream of the rod, the web wrapping around the backing roll so the first surface is facing away from the backing roll; and an air knife directed at the web as it passes over the backing roll to thereby smooth the liquid coating on the first surface of the web.

2. The apparatus of claim 1 wherein the rod and rod holder are mounted on a beam and the catch pan is integral with the beam.

3. The apparatus of claim 2 wherein the beam, the rod, and the rod holder mounted thereon are mounted on actuators for moving the rod into or out of engagement with the first surface of the paper web.

4. The apparatus of claim 1 wherein the rod has a diameter of about one and one-half inches.

5. The apparatus of claim 1 wherein the rod defines about twenty-five degrees of circumference for engaging the web first surface.

6. A method of forming a coated paper web comprising the steps of:

applying a layer of liquid coating from a pan to a first surface of a moving paper web, the motion of the web defining a machine direction of motion;

removing a portion of the layer of liquid with a rotating rod having a circumference, and having a diameter of between about ¼ and about three inches, by wrapping the web around the rod circumference between about three degrees and about forty degrees, so that the first surface of the web engages the rod, and having no opposing backing roll engaging a second surface of the web to form a nip with the rod, the rod being driven by a motor connected in driving relation to the rod, the motor driving the rod to rotate in a direction contrary to the direction of motion of the paper web at a rotation rate of 10 to 500 rotations per minute;

draining excess liquid coating removed from the web first surface by the rod into a catch pan;

causing the web to wrap around a backing roll so the first side is outermost; and directing a stream of air from an air knife onto the web first side while the web is supported on the backing roll, the stream of air smoothing the liquid coating on the web first side.

7. The method of claim 6 wherein the diameter of the rod is about one and one-half inches.

8. The method of claim 6 wherein the web is wrapped around the rod about twenty-five degrees.

9. The method of claim 6 wherein the rod is rotated at about 100 rotations per minute.

10. A coater comprising:

a means for applying a liquid coating to a first surface of a moving paper web;

a liquid coating pan for supplying the means for applying a liquid coating;

a rod spaced in a down machine direction from the means for applying a liquid coating, the rod having a diameter between about ¼ and about 3 inches, the rod defining a circumference, the rod extending in a cross machine direction and engaging the web first surface so that between three degrees and forty degrees of the rod circumference is wrapped by the web, and wherein no other roll engages the web immediately adjacent to the rod;

a holder supporting the rod in the cross machine direction;

a liquid coating catch pan for receiving liquid excess coating removed from the web first surface by the rod;

means for rotating the rod at a rate of between 10 to 500 rotations per minute;

a backing roll positioned downstream of the rod, and not engaging the rod, the web wrapping around the backing roll so the first surface is facing away from the roll; and an air knife directed at the web as it passes over the backing roll so smoothing the liquid coating on the first surface of the web.

11. The apparatus of claim 10 wherein the rod and rod holder are mounted on a beam which incorporates an integral pan for catching liquid coating removed from the web first surface by the rod.

12. The apparatus of claim 11 wherein the beam, the rod and the rod holder mounted thereon are mounted on actuators for moving the rod into or out of engagement with the first surface of the paper web.

13. The apparatus of claim 10 wherein the rod has a diameter of about one and one-half inches.

14. The apparatus of claim 10 wherein the rod defines about twenty-five degrees of circumference for engaging the web first surface.

15. The apparatus of claim 10 further comprising a motor in driving engagement with the rod to cause the rod to rotate toward the means for coating.

16. The coater of claim 10, wherein the liquid coating catch pan is formed integrally with the holder.

* * * * *